US010865954B2

(12) United States Patent
Lu et al.

(10) Patent No.: US 10,865,954 B2
(45) Date of Patent: Dec. 15, 2020

(54) LIGHTING SYSTEM, LIGHTING INSTALLATION AND CEILING INSTALLATION

(71) Applicant: SIGNIFY HOLDING B.V., Eindhoven (NL)

(72) Inventors: Jun Lu, Shanghai (CN); Hao Zhang, Shanghai (CN); Qun Luo, Shanghai (CN); Lei Sui, Shanghai (CN); Gang Wang, Shanghai (CN); Xingpeng Yang, Shanghai (CN); Zhenyi Zheng, Shanghai (CN)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/639,715

(22) PCT Filed: Aug. 16, 2018

(86) PCT No.: PCT/EP2018/072185
§ 371 (c)(1),
(2) Date: Feb. 17, 2020

(87) PCT Pub. No.: WO2019/038168
PCT Pub. Date: Feb. 28, 2019

(65) Prior Publication Data

US 2020/0217467 A1 Jul. 9, 2020

(30) Foreign Application Priority Data

Aug. 22, 2017 (WO) ..... PCT/CN2017/098478
Oct. 12, 2017 (EP) ..... 17196089

(51) Int. Cl.
*F21S 8/06* (2006.01)
*F21V 21/005* (2006.01)
(Continued)

(52) U.S. Cl.
CPC ..... *F21S 8/066* (2013.01); *F21S 8/063* (2013.01); *F21V 21/005* (2013.01);
(Continued)

(58) Field of Classification Search
None
See application file for complete search history.

(56) References Cited

U.S. PATENT DOCUMENTS 4,749,358 A * 6/1988 Soleanski ..... F21V 21/35 439/119
5,276,597 A * 1/1994 Herst ..... F21S 2/00 362/225

(Continued)

FOREIGN PATENT DOCUMENTS

CN 202403203 U 8/2012
CN 203489122 U 3/2014

(Continued)

*Primary Examiner* — Elmito Breval
(74) *Attorney, Agent, or Firm* — Daniel J. Piotrowski

(57) ABSTRACT

A lighting system has a set of linear lighting elements and a set of suspension elements. Each suspension element comprises an upper fixing part and a lower connection part facing downwardly for making electrical and mechanical connection to an upward facing connector on a top face of an end of a linear lighting element. This enables a simple a push fit connection of the lighting elements to the suspension elements, after they have been suspended from a support structure above them.

15 Claims, 12 Drawing Sheets

(51) Int. Cl.

| | |
|---|---|
| ***F21V 21/008*** | (2006.01) |
| ***F21V 21/088*** | (2006.01) |
| ***F21V 21/34*** | (2006.01) |
| ***F21V 23/06*** | (2006.01) |

(52) U.S. Cl.
CPC ..... *F21V 21/008* (2013.01); *F21V 21/088* (2013.01); *F21V 21/34* (2013.01); *F21V 23/06* (2013.01)

(56) References Cited

U.S. PATENT DOCUMENTS

| | | | | |
|---|---|---|---|---|
| 8,454,192 | B2 | 6/2013 | Rouse et al. | |
| 9,285,085 | B2 | 3/2016 | Carney et al. | |
| 9,644,828 | B1 | 5/2017 | May | |
| 2003/0137835 | A1 | 7/2003 | Mier-Langner et al. | |
| 2010/0038509 | A1 | 2/2010 | Russel Clive | |
| 2014/0293595 | A1 | 10/2014 | May | |
| 2016/0209014 | A1* | 7/2016 | Mata | F21V 21/08 |
| 2016/0344174 | A1 | 11/2016 | Murr | |
| 2017/0261190 | A1* | 9/2017 | Hierzer | F21V 21/008 |
| 2018/0031217 | A1* | 2/2018 | Tuchler | F21V 21/35 |

FOREIGN PATENT DOCUMENTS

| | | | |
|---|---|---|---|
| DE | 10163679 | C1 | 9/2003 |
| DE | 202016101438 | U1 | 3/2016 |
| EP | 1847763 | A1 | 10/2007 |
| JP | 2014026937 | A | 2/2014 |
| WO | 9735146 | A1 | 9/1997 |
| WO | 2017120574 | A1 | 7/2017 |

* cited by examiner

LIGHTING SYSTEM, LIGHTING INSTALLATION AND CEILING INSTALLATION

CROSS-REFERENCE TO PRIOR APPLICATIONS

This application is the U.S. National Phase application under 35 U.S.C. § 371 of International Application No. PCT/EP2018/072185, filed on Aug. 16, 2018, which claims the benefit of International Application No. PCT/CN2017/098478, filed on Aug. 22, 2017 and European Patent Application No. 17196089.1, filed on Oct. 12, 2017. These applications are hereby incorporated by reference herein.

FIELD OF THE INVENTION

This invention relates to lighting systems, and in particular for suspension from horizontal support tracks or rods, or for attachment to a horizontal ceiling. The invention also relates to lighting installations including the support structure, as well as ceiling installations which incorporate the lighting installation.

BACKGROUND OF THE INVENTION

Suspended lighting systems are used in many different situations. For example, LED luminaires used in industrial situations, such as warehouses and markets, are often formed suspended from horizontal trunking. The luminaires are elongate lighting strips, and they are aligned end to end to form a continuous illumination effect.

The line of luminaires may be formed as a continuous straight line, but equally corners may be formed in the line of luminaries to enable shaped paths to be formed. A junction between two luminaires may for example form a 90 degree "L" shape, a junction between three luminaires may form a "T" shape, and a junction between four luminaires may from a "+" shape.

To create these interconnections, splicing units may be provided at the ends of the luminaires. The luminaires of the suspended set are connected at their ends to each other, and the interconnected set of luminaires is suspended from the support trunking.

One disadvantage of existing trunking connection methods is that for a luminaire provider, many different splicing parts are needed. For the end user, the existing splicing methods are not flexible enough. In particular, once a particular configuration is completed with the required set of splicing units, users are not generally able to change the layout without buying new splicing components.

The installation of the system is also not easy, since the luminaires must be connected together by the splicing units, as well as implementing the suspension of the interconnected luminaries.

US2014/293595A1 discloses an elongate tubular lighting assembly having a body with a length between spaced first and second ends. Connectors are provided at the ends.

WO97/35146A1 discloses an electrical appliance such as a lamp, which includes attachment means adapted for mounting on a member of the grid of a suspended ceiling. The attachment is in the form of a clip.

SUMMARY OF THE INVENTION

It is a concept of the invention to provide a suspended lighting system in which the lighting elements are a push fit to make both electrical and mechanical connection to suspension elements which hang from an overlying grid type support structure. This simplifies the installation procedure and enables a more modular design.

The invention is defined by the claims.

According to examples in accordance with an aspect of the invention, there is provided a lighting system, comprising:

a set of linear lighting elements; and a set of suspension elements for suspending the lighting elements from a horizontal support, wherein each suspension element comprises an upper fixing part for fixing to the support and a lower connection part for making electrical and mechanical connection to an end of a linear lighting element, wherein the lower connection part comprises a first electrical and mechanical connector at its bottom end for facing downwardly in use, and the linear lighting elements each comprise a second electrical and mechanical connector at each end for facing upwardly in use, wherein the connection between the first and second connectors is a push fit connection, and wherein at least one suspension element comprises an external electrical connection.

This lighting system has suspension elements which provide physical support for suspended linear lighting elements, such as LED tubes. The tubes are a push fit vertically upwards to connect electrically and mechanically to the suspension elements, thus providing a simple installation procedure. Some suspension elements may connect to the end of one lighting element only and other suspension elements may connect to the ends of two lighting elements (and provide an electrical connection between them), to enable a series of lighting elements to be connected. The lighting elements may be suspended from a grid of T-bars forming a ceiling structure. At least one suspension element has an external electrical connection so that power is provided to the set of linear lighting elements by that suspension element. There may be a suspension element with an external electrical connection at one end of the full set of linear lighting elements, although power may be provided to an intermediate location.

A first one of the suspension elements comprises a lower connection part which comprises:

a first suspended support for making electrical and mechanical connection to an end of a first linear lighting element; and a second suspended support for making electrical and mechanical connection to an end of a second linear lighting element, wherein the first and second suspended supports are butted back to back and an electrical connection is provided between the first and second suspended supports of said first one of the suspension elements.

This first suspension element design is dedicated to straight line connections with no gap.

A second one of the suspension elements for example comprises a lower connection part which comprises:

a first suspended support for making electrical and mechanical connection to an end of a first linear lighting element; and a second suspended support for making electrical and mechanical connection to an end of a second linear lighting element, wherein the first and second suspended supports are angularly positioned or positionable at 90 degrees to each other about a suspension direction and wherein the upper fixing part provides electrical connection between the first and second suspended supports.

At least some of the suspension elements enable lighting elements to be connected at 90 degrees so that a freely chosen path of lighting elements may be formed, providing a modular lighting solution. This particular suspension element provides electrical connection between those adjacent lighting elements. Thus, the connection to the suspension elements implements both the suspension of the lighting elements and the electrical interconnection between the lighting elements. The suspension direction is typically vertical and is the direction by which the lighting elements are suspended.

The first and second suspended supports of the second one of the suspension elements may be rotatable about the suspension direction.

This enables the suspension element to be adjustable to a desired angle, including 90 degrees, and optionally including any angle in the range 0 to 90 degrees. The angled suspension element may thus also be used for straight couplings.

The first and second suspended supports of the second one of the suspension elements are for example spaced apart along the linear lighting element direction.

This spacing allows rotation of the supports and takes account of the width of the lighting elements when forming a 90 degree coupling.

A third one of the suspension elements may comprise a lower connection part which comprises:

a single suspended support for making electrical and mechanical connection to an end of a first linear lighting element.

In this case, a suspension element provides an end connector for a run of lighting elements.

In a first set of examples, and for all types of suspension element, the upper fixing part of each suspension element may comprise a pair of spaced apart grips each for gripping opposite edges of a horizontal strip-shaped support and a pair of spring fingers each on an opposite side of the upper fixing part to a respective grip, for implementing a twist and lock attachment to the horizontal support.

This provides a simple push and twist mounting of the suspension elements to a particular design of horizontal support. In a preferable embodiment, the upper fixing part of each suspension element is replaceable, or comprises a replaceable part including the grips. Thus, the lighting system may easily be adapted to different sizes of support.

The spacing between the grips for example forms a diagonal when the suspension element is mounted, and the spacing is slightly greater than the (shortest) width of the horizontal support. This enables insertion of support into the space with an angled orientation of the upper fixing part, and holding of the support with a subsequent straight orientation of the upper fixing part.

The suspension element may further comprise a decorative cover covering the upper fixing part, wherein the decorative cover comprises a recess with a pair of opposing end walls, the upper fixing part comprises a protruding portion adapted to rest in the recess and a pair of extending tips frictionally abutting against the end walls sidewall for holding decorative cover in the covering position.

In a second set of examples, and for all types of suspension element, the upper fixing part of each suspension element comprises a pair of spaced apart lips each for hooking over opposite edges of the horizontal support, wherein the spacing between the lips is adjustable.

This arrangement enables one design of suspension element to mount to different designs of horizontal support.

The upper fixing part of each suspension element may then comprise a slider for manually increasing the spacing and a spring arrangement for closing the spacing.

In this way, the lips grip around the support when released to provide a simple adjustment process.

The spacing is for example adjustable to include at least the range 16 mm to 24 mm.

This adjustment then covers a range of existing support designs, enabling retrofitting of the lighting system to an existing ceiling structure.

Each linear lighting element may comprise an electrical connection port at each end, comprising the second electrical and mechanical connector, for connection to the lower connection part of a suspension element. Each linear lighting element may comprise an LED strip or tube.

The invention also provides a lighting installation comprising:

a grid of strip-shaped horizontal supports; and a lighting system as defined above.

The width of the strip-shaped horizontal support is for example in the range 16 mm to 24 mm.

The invention also a ceiling installation comprising:

a lighting installation as defined above, with the set of linear lighting elements suspended below the grid of strip-shaped horizontal supports; and a set of ceiling tiles fitted in the grid spaces of the grid of strip-shaped horizontal supports.

The set of linear lighting elements may be adapted to project light upwards; and wherein a distance between the linear lighting elements and the ceiling tiles is in a range of 5 cm to 15 cm.

This provides a lighting system which provides upward illumination towards ceiling tiles mounted between the horizontal supports. This provides a low glare aesthetic lighting solution.

These and other aspects of the invention will be apparent from and elucidated with reference to the embodiment(s) described hereinafter.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a lighting system having a set of linear lighting elements and a set of suspension elements. Each suspension element comprises an upper fixing part and a lower connection part facing downwardly for making electrical and mechanical connection to an upward facing connector on a top face of an end of a linear lighting element. This enables a simple a push fit connection of the lighting elements to the suspension elements, after they have been suspended from a support structure above them.

Figure 1:
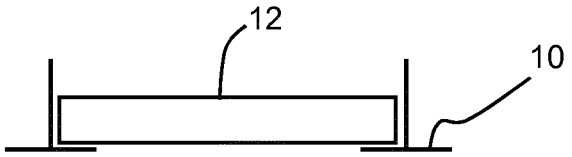
FIG. 1 shows a pair of horizontal strip-shaped T-bar supports with a ceiling panel mounted between them.

FIG. 1 shows a pair of horizontal strip-shaped T-bar supports 10 with a ceiling panel 12 mounted between them. The T-Bar is an aluminum frame for example used in office ceilings, which is used to retain the ceiling tiles or recess luminaires. The bars have a cross-sectional shape which is a reversed (upside down) T-shape.

It is known to use the T-bar supports as a support structure from which luminaires may be suspended, beneath the ceiling formed by the ceiling panels 12. The width of the strip-shaped horizontal support is for example in the range 16 mm to 24 mm, for example 16 mm and 24 mm examples are common.

Figure 2:
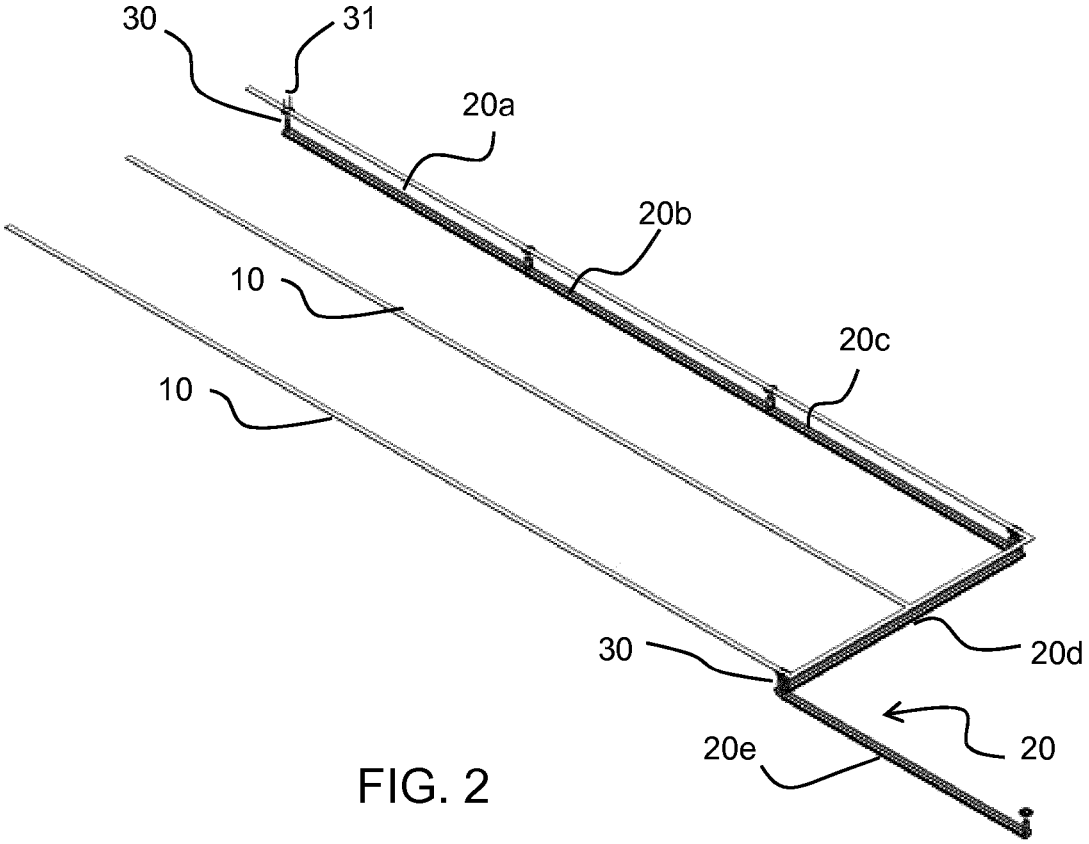
FIG. 2 shows a lighting installation in accordance with one example of the invention.

FIG. 2 shows a lighting installation in accordance with one example of the invention. The installation has a grid of the strip-shaped horizontal supports 10 from which is suspended a lighting system. The lighting system comprises a set 20 of linear lighting elements 20*a* to 20*e* suspended from the supports 10 by a set of suspension elements 30. Each suspension element has an upper fixing part for fixing to the support 10 and a lower connection part for making electrical and mechanical connection to an end of a linear lighting element of the set 20.

FIG. 2 shows an example in which there is a linear section of three lighting elements 20*a* to 20*c*, a 90 degree bend to the next lighting element 20*d* in the series, and a further 90 degree bend to the last lighting element 20*e*.

Each end of each lighting element has a connector which enables mechanical and electrical connection to a suspension element. The suspension element 30 between two adjacent lighting elements provides electrical connection between them. The electrical connections for example place all lighting elements in parallel, for example coupling together high and low DC voltage terminals. In this way, only one suspension element needs to couple the lighting system to an external power supply. For example, FIG. 2 shows an external electrical connection 31 leading from one suspension element, which is for passing through the ceiling into the ceiling void, to make connection to an external supply.

There are optionally different designs of suspension element, to enable a modular design. Thus, by selecting different suspension element designs, any desired path can be formed.

Figure 3:
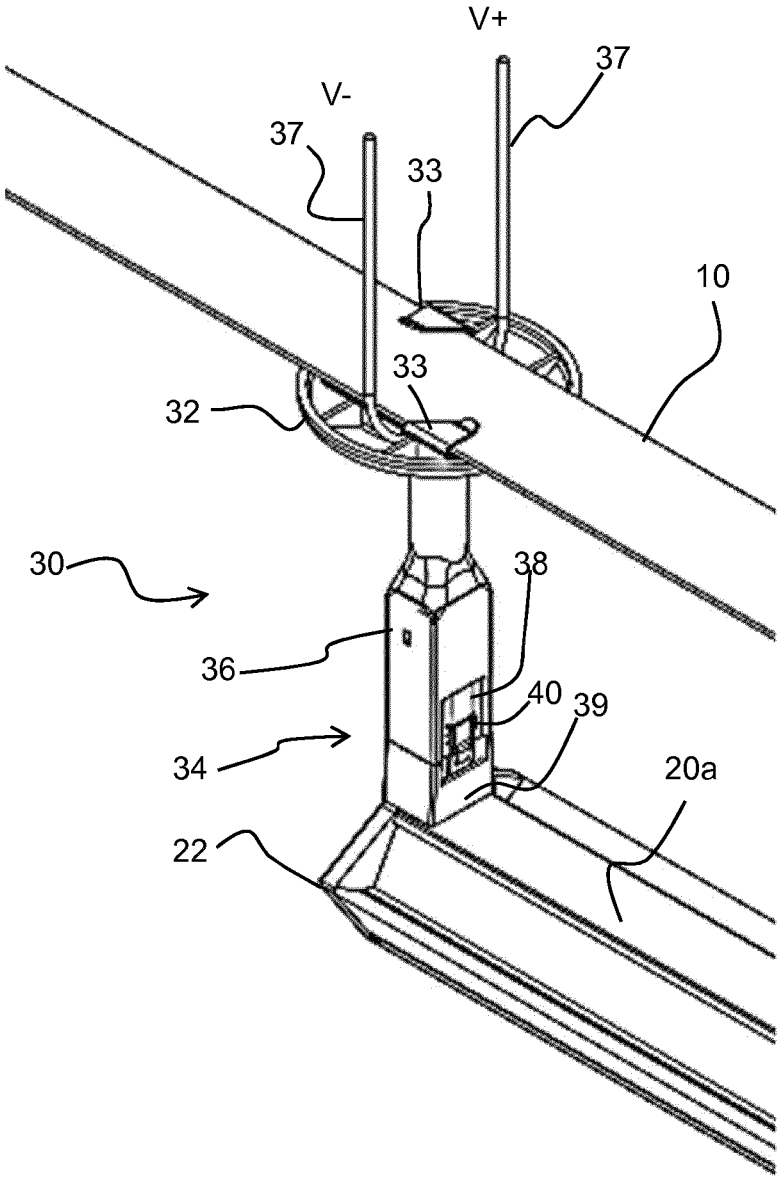
FIG. 3 shows a first type of suspension element, which is for connection to the end of the run of lighting elements.

FIG. 3 shows a first type of suspension element 30, which is for connection to the end of the run of lighting elements.

The suspension element 30 has an upper fixing part 32 for fixing to the support 10 and a lower connection part 34 for making electrical and mechanical connection to an end of a linear lighting element 20*a*. In this example, the fixing part grips around the horizontal track. However, other fixing designs may be used as discussed further below.

The support 10 is elongate, and its elongate axis direction is referred to as the "length" and the transverse direction is referred to as the "width". It has "edges" parallel to the elongate axis direction and these are "sides" of the support 10 separated by the width direction, whereas "ends" are separated by the length direction. The same applies to the upper fixing part; it may be considered to have "sides" corresponding to the sides of the support 10 and "ends". However, this nomenclature is arbitrary and is used for clarity only.

The lower connection part 34 comprises a first electrical and mechanical connector 38 at its bottom end for facing downwardly in use, and the linear lighting elements each comprise a second electrical and mechanical connector 39 at each end 22 for facing upwardly in use. The connection between the first and second connectors 38, 39 is a push fit snap connection.

The design of FIG. 3 has a lower connection part 34 which comprises a single suspended support 36 for making electrical and mechanical connection to an end of a first linear lighting element 20*a*.

The external electrical connection (31 in FIG. 2) is shown in more detail as two connection lines 37 in the form of a DC high (V+) line and a DC low (V−) line. The connector 39 thus has corresponding DC high and low connector terminals.

Figure 4:
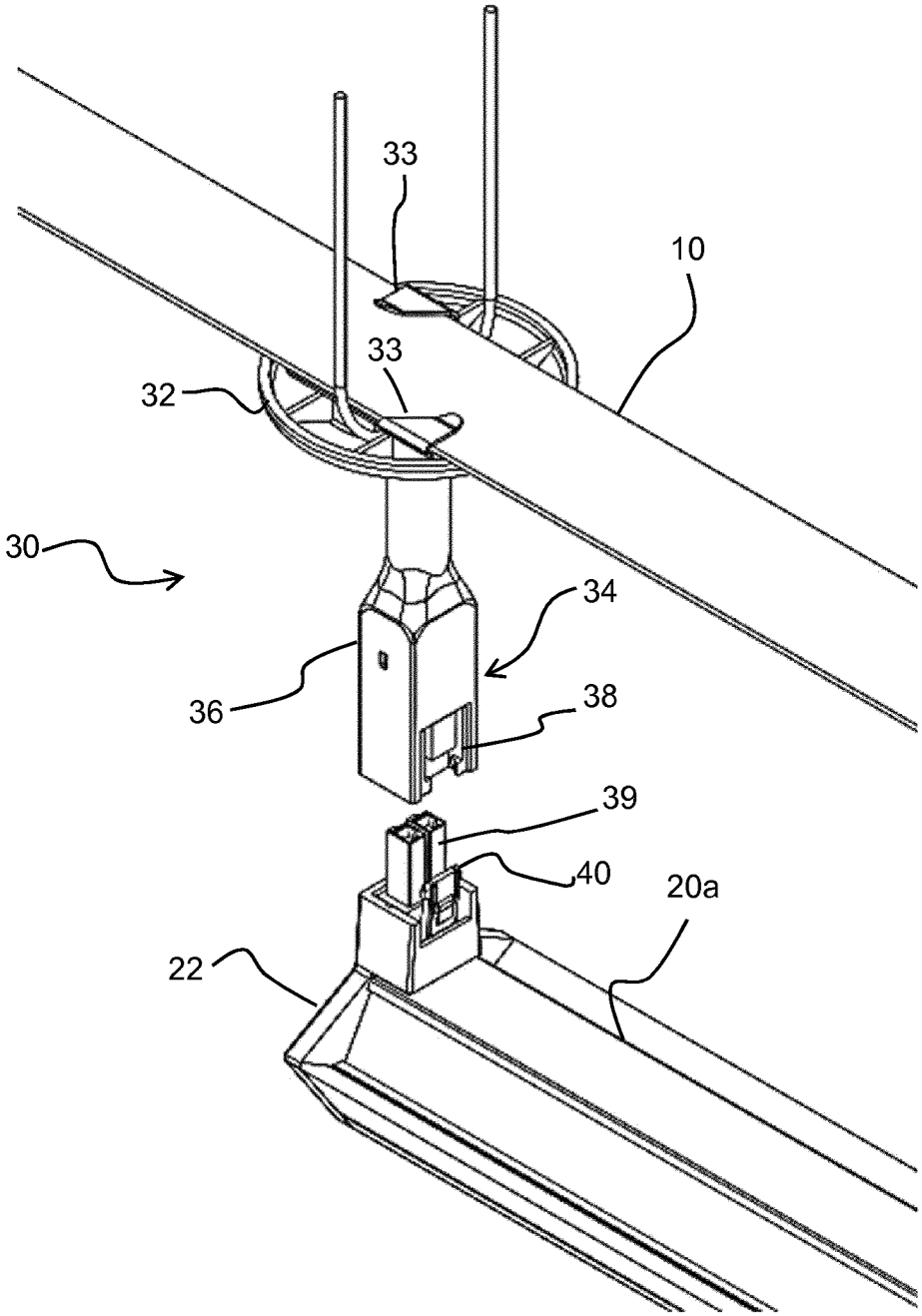
FIG. 4 shows the suspension element of FIG. 3 with the first and second connectors released.

FIG. 3 shows the connectors 38 and 39 coupled together to form an electrical and mechanical connection. The mechanical connection is strong enough to support the weight of the lighting element in a safe manner, and it is engaged by a push and click action. It can be released by pressing on a release button 40 forming (in this example) part of the second connector 39. FIG. 4 shows the suspension element of FIG. 3 with the first and second connectors released.

Figure 5:
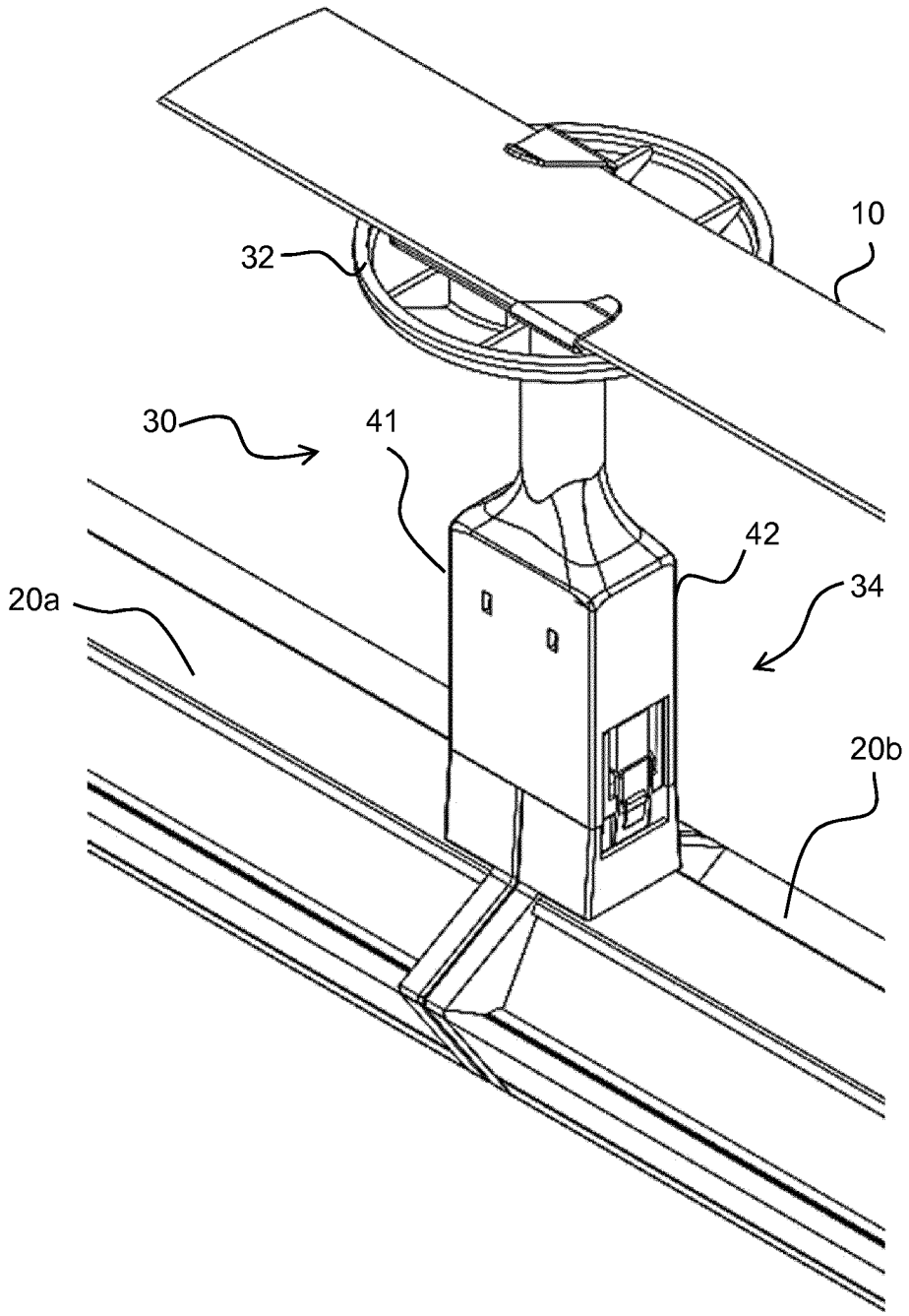
FIG. 5 shows another design of suspension element for connecting two lighting elements in a straight line.

FIG. 5 shows another design of suspension element 30 for connecting two lighting elements in a straight line. The lower connection part 34 in this case comprises a first suspended support 41 for making electrical and mechanical connection to an end of a first linear lighting element 20*a* and a second suspended support 42 for making electrical and mechanical connection to an end of a second linear lighting element 20*b*. The first and second suspended supports 41, 42 are butted back to back, and indeed they may be formed as a single integrated unit as shown in FIG. 5. An electrical connection is provided between the first and second suspended supports 41, 42.

By providing the electrical connection as part of the suspension element, there is no need for separate splicing units. Instead, the lighting elements may be pushed into place and this provides both mechanical suspension as well as the required electrical connections. This enables a straight series of lighting elements to be connected with no gap between their ends. It means that external electrical connection through the ceiling is only required at one location.

By connecting all lighting elements in parallel, any number of elements may be connected (within the power supply limits of the system). The power supply may for example by 12V or 24V DC.

Figure 6:
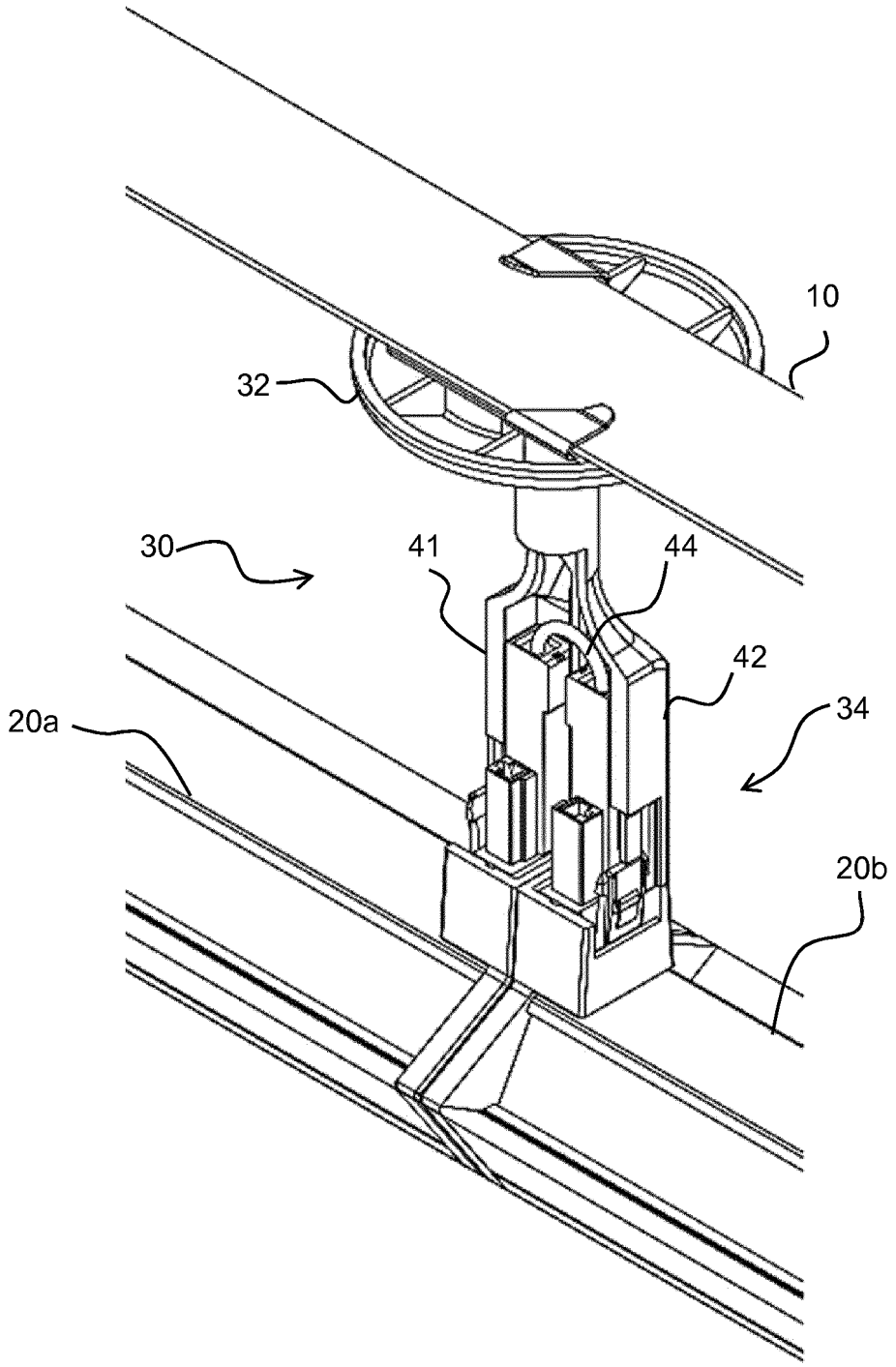
FIG. 6 shows the suspension element of FIG. 5 with the lower connection part cut away to show one of the connection wires.

FIG. 6 shows the suspension element of FIG. 5 with the lower connection part 34 cut away to show one of the connection wires 44 which couples the electrical connectors of the two adjacent lighting elements 20*a*, 20*b*. Thus, the electrical connection comprises a first connection wire 44 (e.g. for V+ to V+) and a second connection wire (not shown, e.g. for V− to V−).

Figure 7:
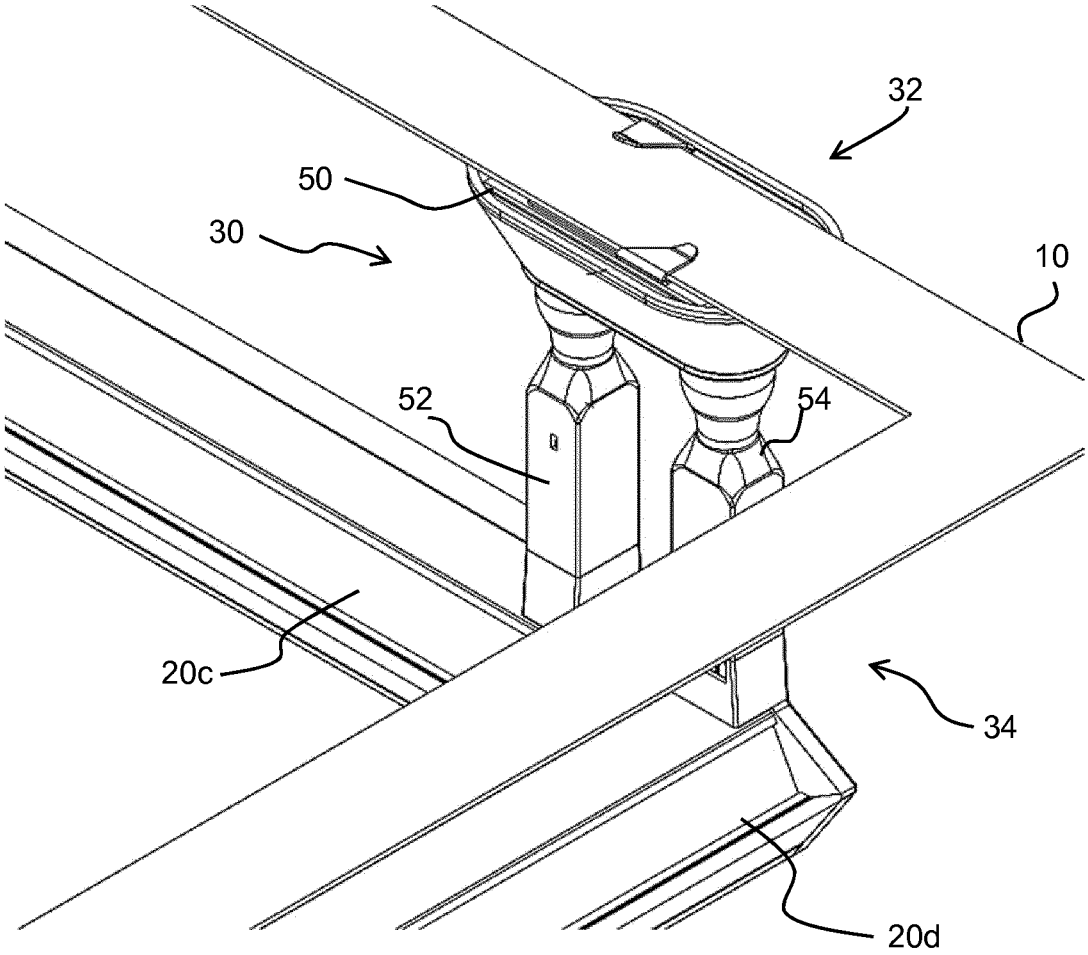
FIG. 7 shows another design of suspension element in which the lower connection part comprises two suspended supports.

FIG. 7 shows another design of suspension element 30 in which the lower connection part 34 comprises a first suspended support 52 for making electrical and mechanical connection to an end of a first linear lighting element 20*c* and a second suspended support 54 for making electrical and mechanical connection to an end of a second linear lighting element 20*d*. A decorative cover 50 covers the upper fixing part 32.

FIG. 7 shows the two supports at 90 degrees with respect to each other (about a vertical axis, which is a suspension direction). The two adjacent lighting elements are thus connected at 90 degrees so that a freely chosen path of lighting elements may be formed, providing a modular lighting solution. The suspension element provides electrical connection between those adjacent lighting elements in the same manner as explained above. The connection wires pass through the upper fixing part 32.

The 90 degree angle may be fixed, since the most common pattern will have 90 degree bends. However, the first and second suspended supports 52, 54 may instead be rotatable about the suspension direction (i.e. vertical). During rotation, the electrical connections between the two lower connection parts remain intact. This enables the angle to be adjustable (including 90) degrees, and optionally including any angle in the range 0 degrees (for straight line connection) to 90 degrees. This allows any angle between adjacent lighting elements from 90 degrees to 180 degrees. A larger angle range may even be used, so that an acute angle may be formed, but there is of course a limit when the two lighting elements will butt against each other. The suspension element may thus also be used for straight couplings so that the design of FIGS. 5 and 6 is not in fact needed.

The first and second suspended supports 52, 54 are spaced apart along the linear lighting element direction. This spacing allows the lighting elements to couple at angles other than in a straight line.

Figure 8:
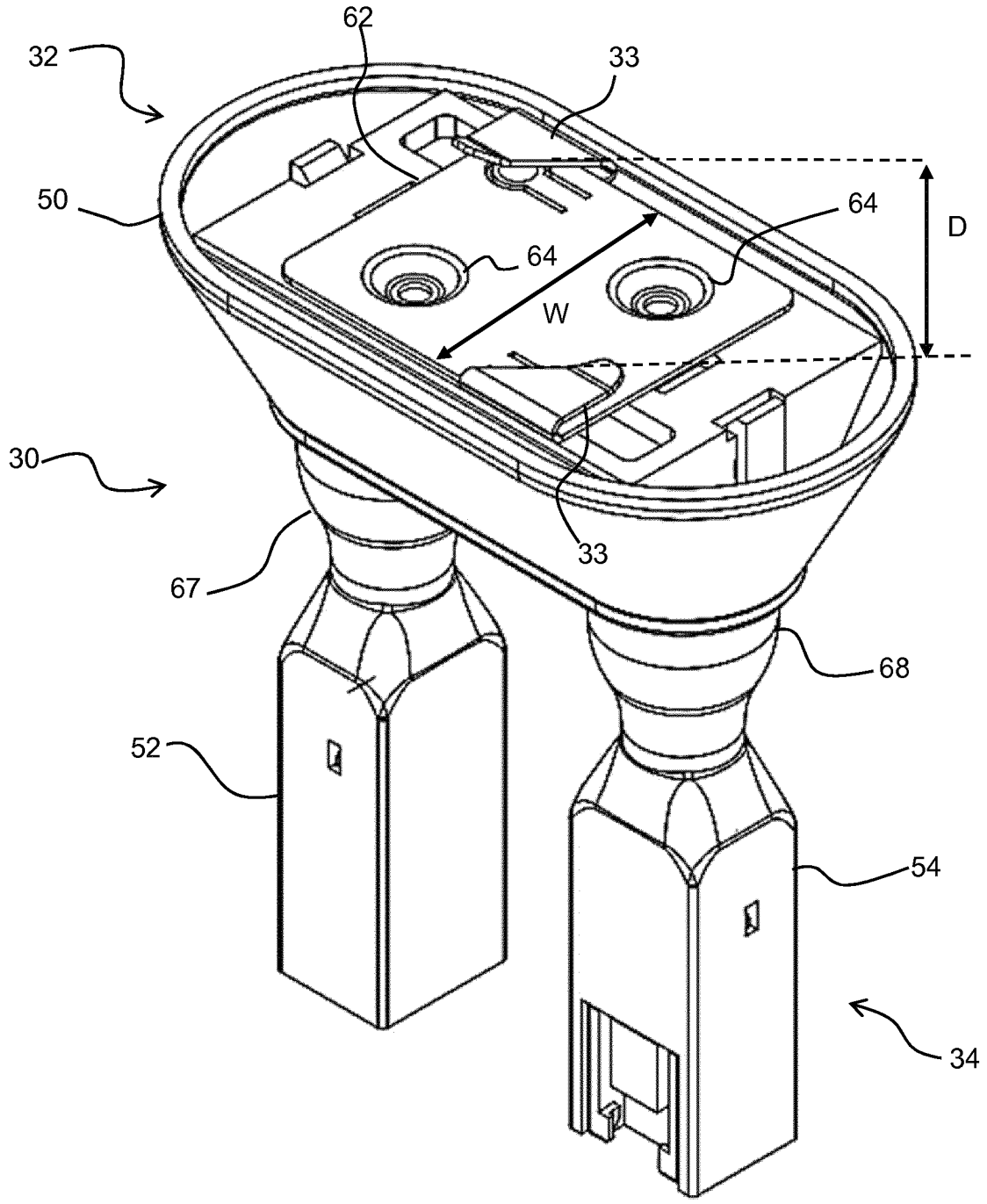
FIG. 8 shows the suspension element of FIG. 7 in more detail.

FIG. 8 shows the suspension element of FIG. 7 in more detail. Each support 52, 54 has a vertical rotation axis and a rotatable coupling 67, 68 to the upper fixing part 32.

The examples above all have the same basic design of upper fixing part 32.

With reference to FIG. 8, the upper fixing part 32 comprises a pair of spaced apart grips 33 each for gripping opposite edges of the strip-shaped horizontal support 10 for implementing a twist and lock attachment to the horizontal support.

This provides a simple push and twist mounting of the suspension element to a particular design of horizontal support. A diagonal spacing D between the grips 33 is marginally larger than the width W of the support 10 so that the upper fixing part can be pushed over the support. It is then twisted to engage the support 10. Thus D>W (in that D is a rectangular diagonal dimension and W is a rectangular height dimension).

One fixing part is thus designed for one width of support. However, the upper fixing part 32 may have a removable interface part 62, so that different interface parts 62 may be fitted to a standard suspension element design, to adapt the design to a particular support width. The interface part 62 connects with screws 64. Differently sized interface parts 62 (with different spacing D and width W) may be mounted. A larger section of the upper fixing part 32 may instead be replaceable.

The fixing part of all designs above is for gripping over the lateral edges of a strip-shaped horizontal support. The support may instead be a set of rods or wires for which a different fixing part may be appropriate.

Figure 9:
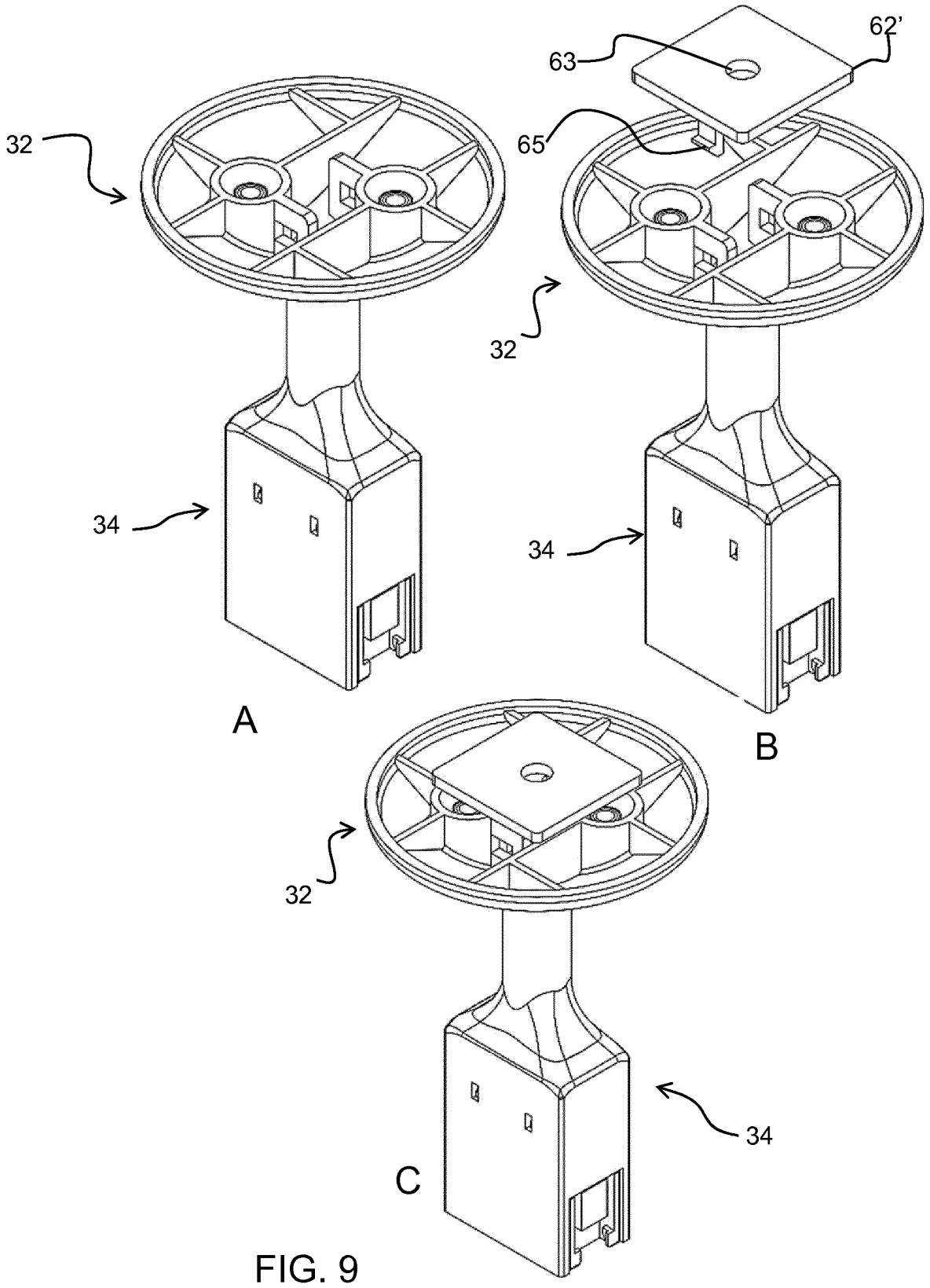
FIG. 9 shows a different design for the fixing part of the suspension element for attachment to a ceiling rather than for gripping trunking.

In another variation, the lighting is to be suspended from a solid ceiling. FIG. 9 shows how a different interface part 62' may be used to enable suspension from a solid surface. FIG. 9A shows a suspension element (of the type shown in FIG. 5) with the interface part removed. FIG. 9B shows the different design of interface part 62'. It has a mounting hole 63 through which it is screwed to the ceiling. Thus, this interface part fixes to the ceiling by screws rather than by gripping function. The interface part 62' has a pair of suspended snap fit latches 65. The remainder of the fixing part 32 is a push fit over these latches 65 so that the fixing part clicks onto the interface part 62' and the fixing part then suspends from the ceiling. The connected interface part 62' is shown in FIG. 9C.

The lighting elements are then suspended in the same way as described above.

The fixing part thus enables fixing to different types of support. There may be an interchangeable modular design for different types and sizes of support but equally there may be completely different designs for different support structures.

An alternative design of fixing part of the suspension element 30 will now be described with reference to FIGS. 10 to 12.

Figure 10:
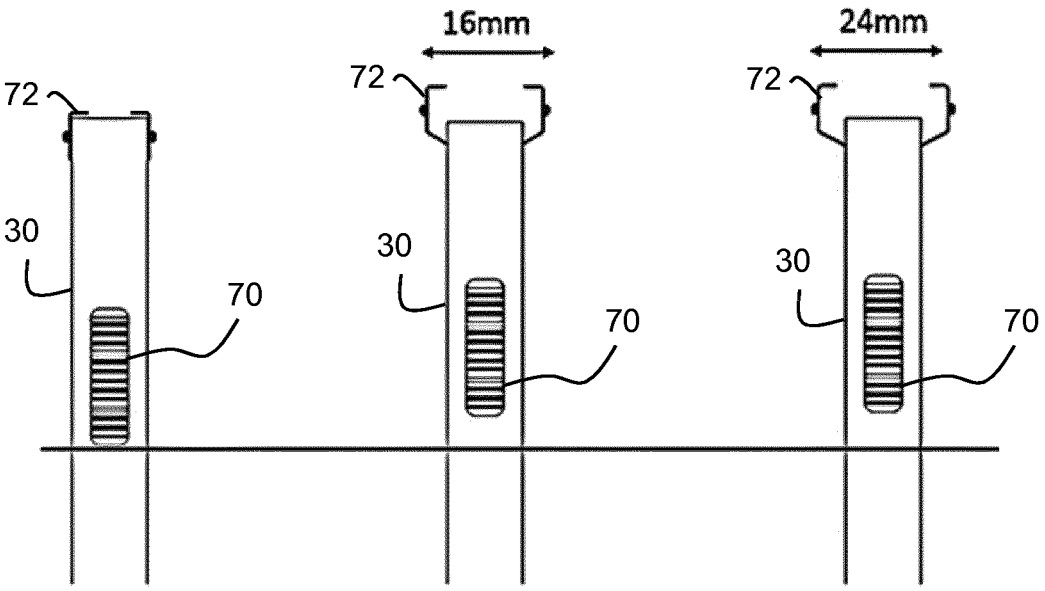
FIG. 10 shows an alternative design of fixing part of the suspension element.

As shown in FIG. 10, in this design, the upper fixing part of each suspension element comprises a pair of spaced apart lips 72 each for hooking over opposite edges of the horizontal support. The spacing between the lips 72 is adjustable by operating a slider 70 for manually increasing the spacing. A spring arrangement closes the spacing when the slider is released.

This arrangement enables one design of suspension element to mount to different designs of horizontal support, for example 16 mm and 24 mm as shown. For this purpose, the spacing is adjustable to include at least the range 16 mm to 24 mm. Of course, the same design may be adapted to cover a wider or indeed different desired range of widths. The lips 72 grip around the support when released to provide a simple fitting process.

Figure 11:
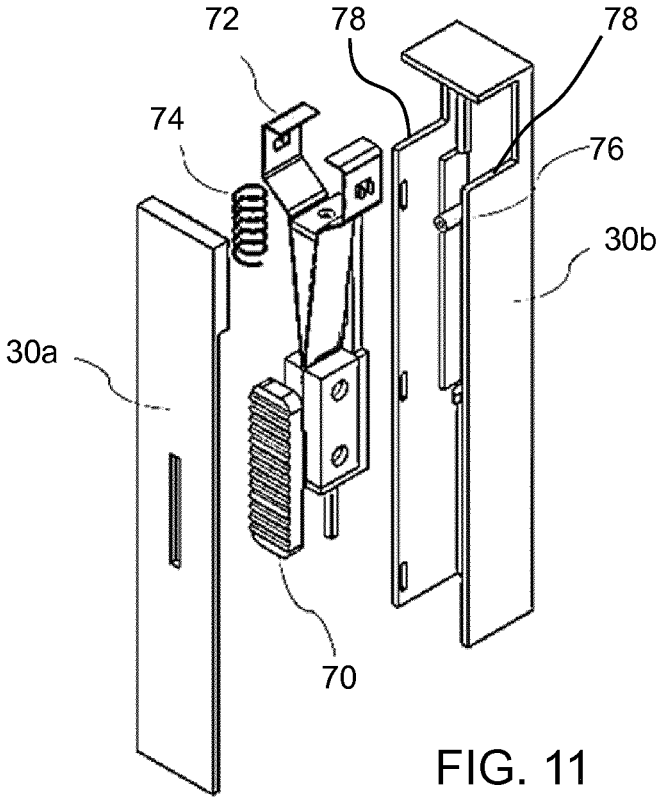
FIG. 11 shows the internal parts of the top part of the suspension element of FIG. 9 in exploded view.

FIG. 11 shows the internal parts of the top part of the suspension element in exploded view.

A spring 74 pushes down on a V-shaped sprung element which forms the lips 72, and causes them to close together. The slider 70 when pushed provides a force against the spring to push the lips 72 apart as they project further out of openings 78. The amount by which the lips can open apart depends on the pusher position.

Figure 12:
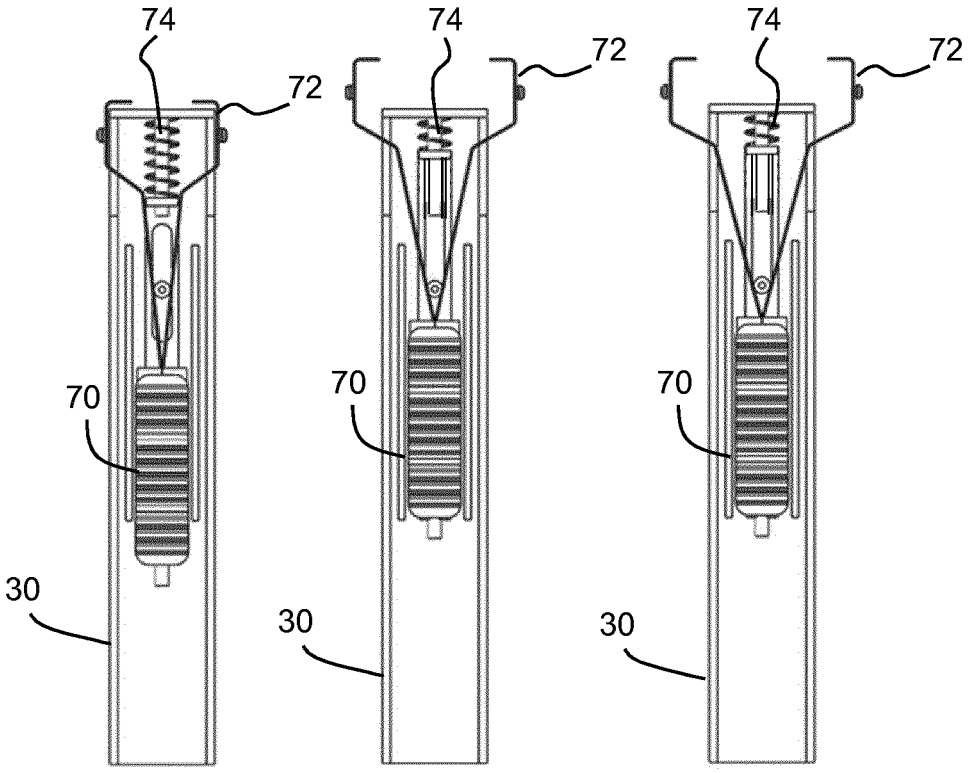
FIG. 12 shows the position of the internal components of the design of FIG. 10 for three different width positions.

FIG. 12 shows the position of the internal components of the design of FIG. 10 for three different width positions.

The lower connection part is not shown in FIGS. 10 to 12, but the same design as shown in FIGS. 3 to 9 may be used.

The twist and lock function described above is based on a pair of grips 33, one on each lateral side of the fixing part. The grips provide an initial fixing to the support 10, but the subsequent connection of the lighting elements 20, 20*b* etc. renders the overall structure rigid so that the upper fixing parts cannot become released accidentally.

Figure 13:
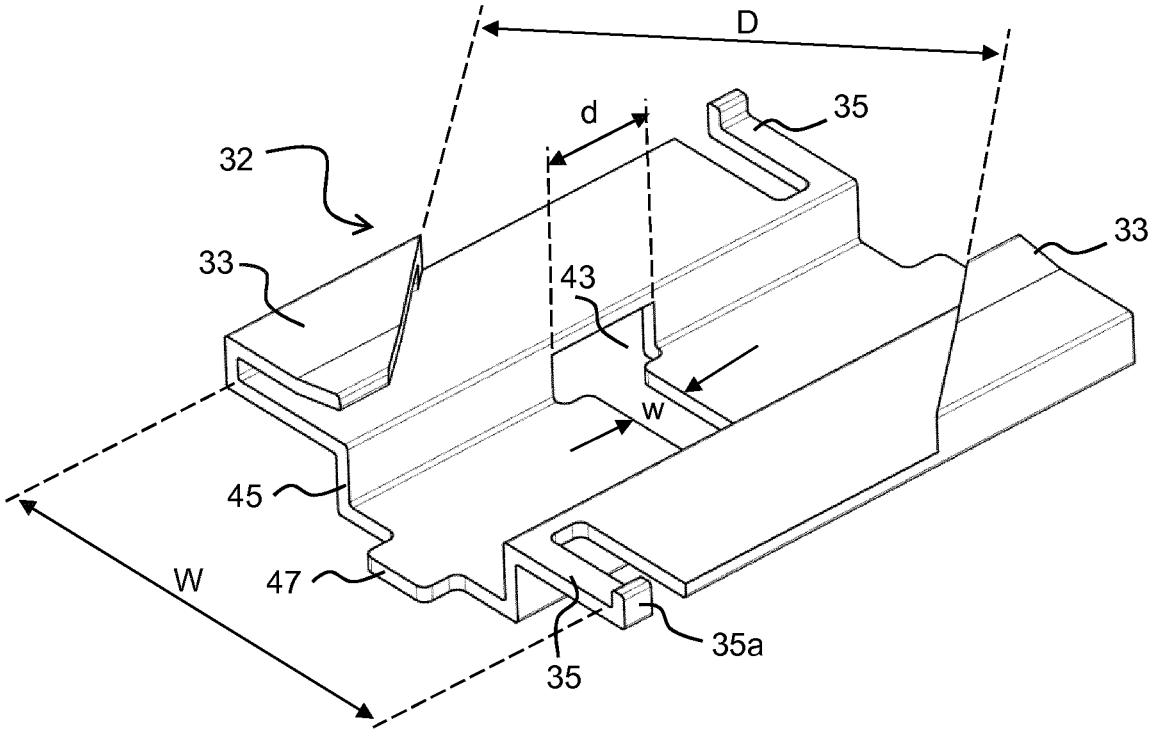
FIG. 13 shows another design of the fixing part of the suspension element.
Figure 14:
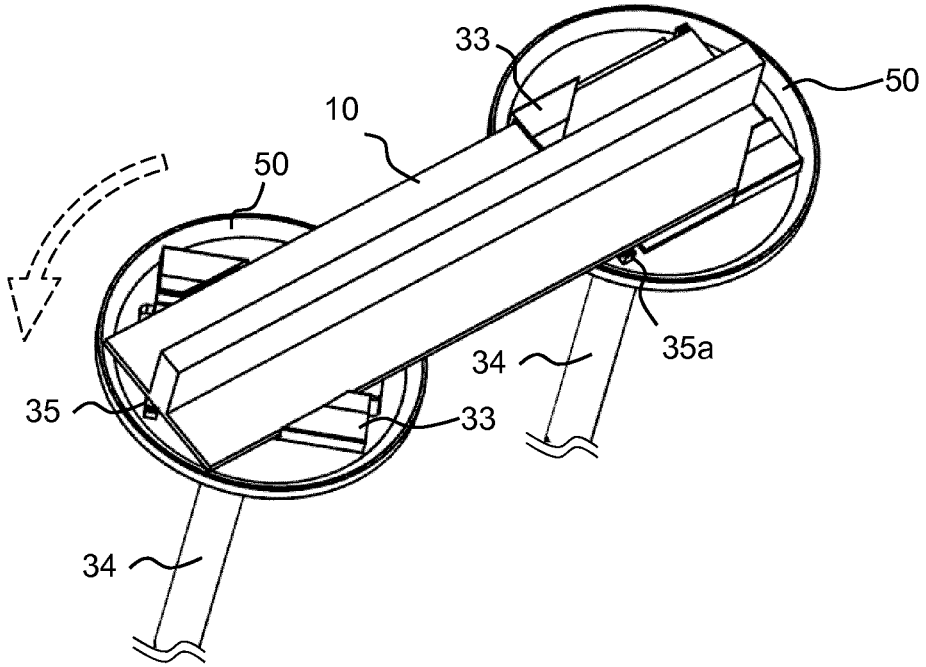
FIG. 14 shows the twist and lock mechanism using the fixing part shown in FIG. 13.

FIG. 13 shows another design of the fixing part of the suspension element in which an additional locking feature is provided. FIG. 14 shows the twist and lock mechanism using the fixing part shown in FIG. 13.

The upper fixing part 32 of the suspension element 30 again has a pair of grips 33 on opposite sides but further comprises a pair of spring fingers 35, with each finger on an opposite side to a respective grip 33. Each spring finger comprises a fingertip 35*a* protruding slightly upwardly. Each finger is spring biased upwardly, so that the fingertip 35*a* can be pushed down by the support (when the upper fixing part is aligned diagonally beneath the support 10) and can then spring up (when the upper fixing part is correctly aligned with the support 10) to perform a locking function. Thus, there is one attachment type in the form of a grip channel into which the support is inserted by rotation, and another attachment type in the form of a finger which serves to prevent reverse rotation. Thus, there is a retaining channel and a sprung locking clip. The upper fixing part can nevertheless be removed by the user by pulling down on the pair of fingertips as well as performing the required rotation.

The slightly protruding fingertips 35*a* do not obstruct the pushing and twisting installation function, but together with the grips 33, they enable improved locking of the upper fixing part 32, and hence the suspension element 30, to the support 10.

Figure 15:
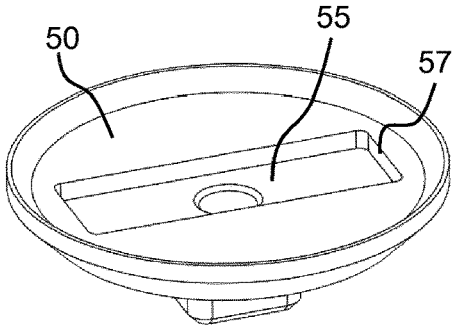
FIG. 15 show a decorative cover.

FIG. 15 shows the initial diagonal coupling of the upper fixing part to the support 10 (left image) and the final locking (right image). The fingers are pushed down by the initial diagonal connection (left image), and they then spring back up to lock the support and the upper fixing part together (right image).

The suspension element 30 may further comprise a decorative cover 50 as mentioned above. One embodiment of the cover 50 is shown in FIG. 15, which comprise a recess 55 with a pair of opposing end walls 57 spaced along the length direction. The corresponding upper fixing part 32 comprises a protruding portion 45 (also shown in FIG. 13) which can rest in the recess 55. There are a pair of extending tips 47 on the protruding portion 45 of upper fixing part. The extend in the length direction in the example shown.

Figure 16:
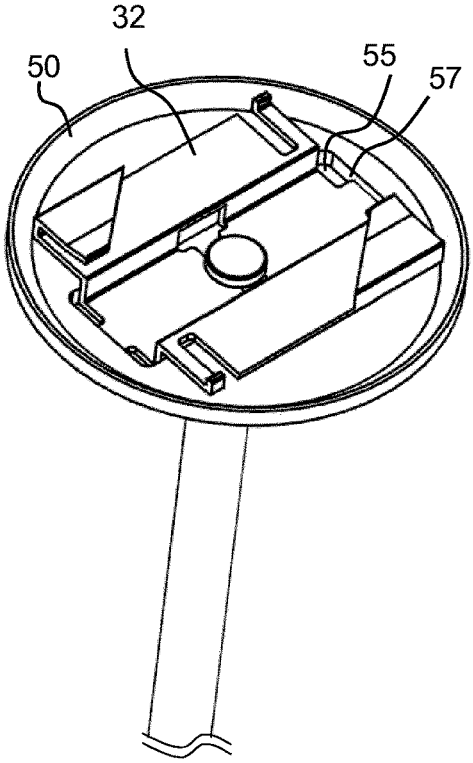
FIG. 16 shows the mechanism for holding of the decorative cover shown in FIG. 15 with the fixing part shown in FIG. 13.

FIG. 16 shows the mechanism for holding of the decorative cover shown in FIG. 15 with the fixing part shown in FIG. 13. As shown in FIG. 16, the function of the tips 47 are that they can frictionally abut against the end walls 57 of the recess 55 in the decorative cover 50, to hold the cover in the covering position over the upper fixing part 32.

The upper fixing part 32 may further comprise a slot 43, referring to FIG. 13. The slot 43 has a continuous open width "d" on a sidewall of the protruding portion 45, and a smaller open width "w" on a bottom of the protruding portion 45. The purpose of the slot 43 is to enable connection to a lower connection part 34 in the form of a head (which can only pass laterally through the wider opening on the sidewall of the protruding portion) and a narrower neck.

Figure 17:
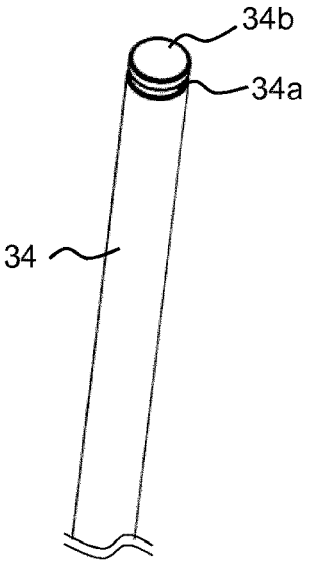
FIG. 17 shows an example of a head portion of the lower connection part.
Figure 18:
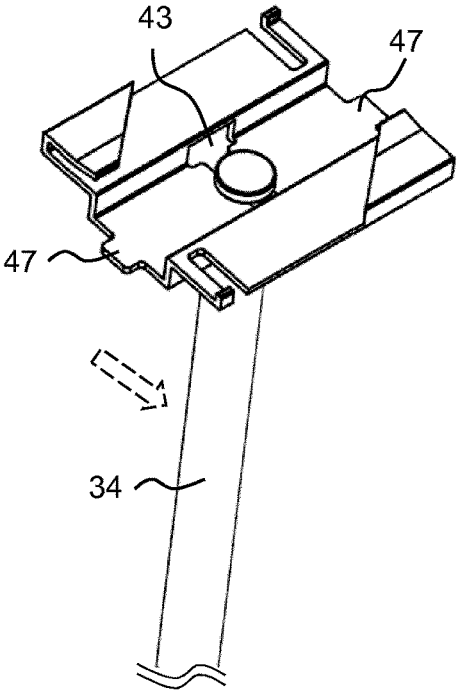
FIG. 18 shows the mechanism for connecting the lower connection part shown in FIG. 17 with the fixing part shown in FIG. 13.

FIG. 17 shows the design of the lower connection part 34 for use with the upper fixing part of FIG. 13, and FIG. 18 shows the connection mechanism between the upper fixing part and the rest of the lower connection part 34. The head portion of the lower connection part 34 includes a neck 34*a* and a rod head 34*b*. The dimension of "d" and "w" correspond to the dimensions of the neck and head. In other words, the dimension "d" of the slot 43 is big enough to allow the rod head 34*b* pass through, and the dimension "w" of the slot 43 allows the neck 34*a* to pass through but prevents the rod head 34*b* falling down. Thus the lower connection part 34 can be easily slid into the upper fixing part 32 laterally, i.e. along the direction of the bold dash-lined arrow shown in FIG. 18.

Note that the double connector design of FIG. 6 or of FIG. 7 may be used at the end of the line of lighting elements, instead of having the separate single design of FIG. 3. One bottom connector would simply be redundant when used as an end suspension element.

Similarly, all suspension elements could have an external power connection capability, so that a dedicated design is not needed for the external electrical connection. For example, a system could be based only on the design of FIG. 7, having a set of external connection terminals. This terminal set would only need to be used for one of the suspension elements. Having different designs of suspension element thus enables a more aesthetically pleasing design, but is not required for the system to be functional.

There may be other suspension element designs, for example for a "T" shaped coupling or a "+" shaped coupling. However, a separate in-line suspension element and end suspension element may be used to form a "T" shape, if those two series runs each have their own external electrical connections.

The lighting elements may be adapted to project light upwards when suspended, thus providing indirect lighting using reflection from the ceiling below which they are suspended. As explained with reference to FIG. 1, the ceiling is formed of ceiling tiles between the supports. The distance between the linear lighting elements and the ceiling tiles is preferably in a range of 5 cm to 15 cm.

The invention is of interest generally for a lighting system which hangs down from a support structure. In office lighting systems, recessed luminaires are commonly used and suspended lighting systems are not commonly used. However, the system described above may use the conventional frames (T-bars) which are originally for the recessed luminaires to be used as the support structure for a suspended lighting solution. Thus, the invention may be used where there is an existing support structure for suspended lighting, or where there is a support structure for recessed lighting, or where there is a solid ceiling.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A lighting system, comprising:

a set of linear lighting elements; and a set of suspension elements for suspending the lighting elements from a horizontal support, wherein each suspension element comprises an upper fixing part for fixing to the support and a lower connection part for making electrical and mechanical connection to an end of a linear lighting element, wherein the lower connection part comprises a first electrical and mechanical connector at its bottom end for facing downwardly in use, and the linear lighting elements each comprise a second electrical and mechanical connector at each end for facing upwardly in use, wherein the connection between the first and second connectors is a push fit connection, and wherein at least one suspension element comprises an external electrical connection, and wherein a first one of the suspension elements comprises a lower connection part which comprises:

a first suspended support for making electrical and mechanical connection to an end of a first linear lighting element; and a second suspended support for making electrical and mechanical connection to an end of a second linear lighting element, wherein the first and second suspended supports are butted back to back and an electrical connection is provided between the first and second suspended supports of said first one of the suspension elements.

2. A lighting system as claimed in claim 1, wherein a second one of the suspension elements comprises a lower connection part which comprises:

a first suspended support for making electrical and mechanical connection to an end of a first linear lighting element; and a second suspended support for making electrical and mechanical connection to an end of a second linear lighting element, wherein the first and second suspended supports are angularly positioned or positionable at 90 degrees to each other about a suspension direction and wherein the upper fixing part provides electrical connection between the first and second suspended supports.

3. A lighting system as claimed in claim 2, wherein the first and second suspended supports of the second one of the suspension elements are rotatable about the suspension direction.

4. A lighting system as claimed in claim 2, wherein the first and second suspended supports of the second one of the suspension elements are spaced apart along the linear lighting element direction.

5. A lighting system as claimed in claim 1, wherein a third one of the suspension elements comprises a lower connection part which comprises:

a single suspended support for making electrical and mechanical connection to an end of a first linear lighting element.

6. A lighting system as claimed in claim 1, wherein the upper fixing part of each suspension element comprises a pair of spaced apart grips each for gripping opposite edges of a horizontal strip-shaped support and a pair of spring fingers each on an opposite side of the upper fixing part to a respective grip, for implementing a twist and lock attachment to the horizontal support.

7. A lighting system as claimed in claim 1, further comprising a decorative cover covering the upper fixing part, wherein the decorative cover comprises a recess with a pair of opposing end walls, the upper fixing part comprises a protruding portion which is adapted to rest in the recess and a pair of extending tips frictionally abutting against the end walls for holding decorative cover.

8. A lighting system as claimed in claim 1, wherein the upper fixing part of each suspension element comprises a pair of spaced apart lips each for hooking over opposite edges of the horizontal support, wherein the spacing between the lips is adjustable.

9. A lighting system as claimed in claim 8, wherein the upper fixing part of each suspension element comprises a slider for manually increasing the spacing and a spring arrangement for closing the spacing.

10. A lighting system as claimed in claim 8, wherein the spacing is adjustable to include at least the range 16 mm to 24 mm.

11. A lighting system as claimed in claim 1, wherein each linear lighting element comprises an electrical connection port at each end, comprising the second electrical and mechanical connector, for connection to the lower connection part of a suspension element.

12. A lighting system as claimed in claim 1, wherein each linear lighting element comprises an LED strip or tube.

13. A lighting installation comprising:

a grid of strip-shaped horizontal supports; and a lighting system as claimed in claim 1.

14. A ceiling installation comprising:

a lighting installation as claimed in claim 13, with the set of linear lighting elements suspended below the grid of strip-shaped horizontal supports; and a set of ceiling tiles fitted in the grid spaces of the grid of strip-shaped horizontal supports.

15. A ceiling installation as claimed in claim 14, wherein the set of linear lighting elements are adapted to project light upwards; and wherein a distance between the linear lighting elements and the ceiling tiles is in a range of 5 cm to 15 cm.

* * * * *